United States Patent [19]

Calvagno

[11] Patent Number: 4,520,591

[45] Date of Patent: Jun. 4, 1985

[54] GARAGE DOOR SAFETY LOCKING SYSTEM

[76] Inventor: Michael J. Calvagno, 11 Samuel St., Nesconset, N.Y. 11767

[21] Appl. No.: 590,364

[22] Filed: Mar. 16, 1984

[51] Int. Cl.[3] ..... E05D 17/00

[52] U.S. Cl. ..... 49/322; 160/193

[58] Field of Search ..... 49/322; 160/193

[56] References Cited

U.S. PATENT DOCUMENTS

| | | | |
|---|---|---|---|
| 3,188,698 | 6/1965 | Zoll et al. | 49/322 |
| 3,426,829 | 2/1969 | McDaniel et al. | 49/322 X |
| 3,579,910 | 5/1971 | Wetter | 49/322 |
| 4,080,757 | 3/1978 | Westerman | 49/322 |

*Primary Examiner*—Philip C. Kannan
*Attorney, Agent, or Firm*—Leonard Belkin

[57] ABSTRACT

A safety lock assembly for use with a garage door to prevent the latter from falling uncontrollably in the event the counterweight system supporting the garage door fails. The invention has a pivoted arm biased into a position blocking door movement. The counterweight system is attached to the pivoted arm to overcome the bias. In the event of a failure in the weight supporting members, the built-in bias will move the arm into its position where further significant movement of the door is prevented.

5 Claims, 6 Drawing Figures

GARAGE DOOR SAFETY LOCKING SYSTEM

BACKGROUND OF THE INVENTION

This invention relates to a garage door safety locking system and more particularly to a garage door safety locking system in which the door is automatically and quickly locked against further movement in the event a supporting spring or cable snaps thereby releasing the door.

A typical and common garage door configuration involves the use of a pair of tracks mounted on opposite sides of the door opening and curved to extend back into the garage, with wheels or rollers mounted on the sides of the door to move within the track.

When the door is in its fully open position, it extends back over the opening parallel to the floor. As the door is being closed it begins to develop a downward component of force due to its weight as the track curves downwardly. To prevent the door from crashing down under its own weight while it is in the partially open position, a counter weight is ordinarily provided in which at least one cable is connected at one end to the door and at its opposite end to a spring which is attached to the building frame or track.

The force of the spring is designed to balance approximately the weight of the door to make it easier to raise the door from its closed position and also to reduce the possibility of an accident should the door handle be released before it is fully open or fully closed.

As the spring exerts a more or less constant force over its range of expansion, the force on the door due to its weight tending to bring it down is not normally exactly balanced because this force depends on the position of the door. Thus, where the door is fully closed, the spring force is not adequate to raise it and some lifting effort is required. When the door is partially open at some point, the spring force and the vertical component of the door's weight may be in balance. When the door is open further, spring force may pull the door into its fully open position.

One of the problems with the arrangement as just described is the significant safety hazard should the spring or its connected cable snap while the door is being opened or closed. Garage doors are operated on a daily basis for years without attention or maintenance. Twenty years or more may go by without an inspection of its mechanism, especially when it continues to operate without problems.

It is therefore of no surprise that eventually there may occur a failure of some part of the mechanism. If the failure is in the spring or the connecting cable while the door is being opened or closed, the whole weight of the door, which can be considerable, can be applied to the person who is holding the door handle. If the operator is a child, or even an adult taken totally by surprise, severe physical injury or even death can be caused by the door crashing to its closed position.

SUMMARY OF THE PRESENT INVENTION

In accordance with the principles of this invention, the safety problems which exist in present garage door operating systems are substantially reduced or overcome by providing a mechanism which upon the supporting cable going slack due to spring or cable failure inserts rapidly into the track an impediment to movement of the wheels or rollers attached to the door, thereby quickly and safely bringing door movement to a halt within a short distance.

A preferred embodiment of this invention consists of a bracket mounted on the outside of each track in which the wheels move. The track has an opening under the bracket aligned with a bracket opening. A lever is pivoted on the bracket having one leg provided with a protuberance which will pass into the track through both openings when the lever pivots in one direction, its locking position. A pair of springs on the bracket biases the lever in that direction. Another leg on the lever is attached to the cable which supports the door and the force of the spring attached to the cable is sufficient to overcome the bias on the lever and pivot it away from its locking position.

In the event of the failure of the door spring or its cable, the latter will go slack, and the lever will snap into its locking position, thereby limiting further movement of the garage door, presumably preventing injury to anyone or thing present in the garage door opening.

It is therefore a principal object of this invention to provide a unique safety device for use with garage doors to prevent accidents with resulting injury due to failure of a supporting cable or spring.

Other objects and advantages of this invention will hereinafter become obvious from the following description of a preferred embodiment of this invention.

DESCRIPTION OF THE PREFERRED EMBODIMENT

Figure 1:
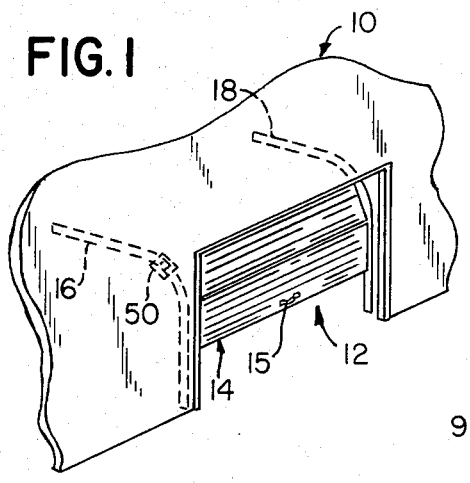
FIG. 1 shows the side of a garage with a garage door partially open.

Referring to FIG. 1, there is shown a garage 10 with an opening 12 for a partially open garage door 14, having a handle 15, and riding on tracks 16 and 18. Door 14 and tracks 16 and 18 are of conventional construction as will be described below.

Figure 2:
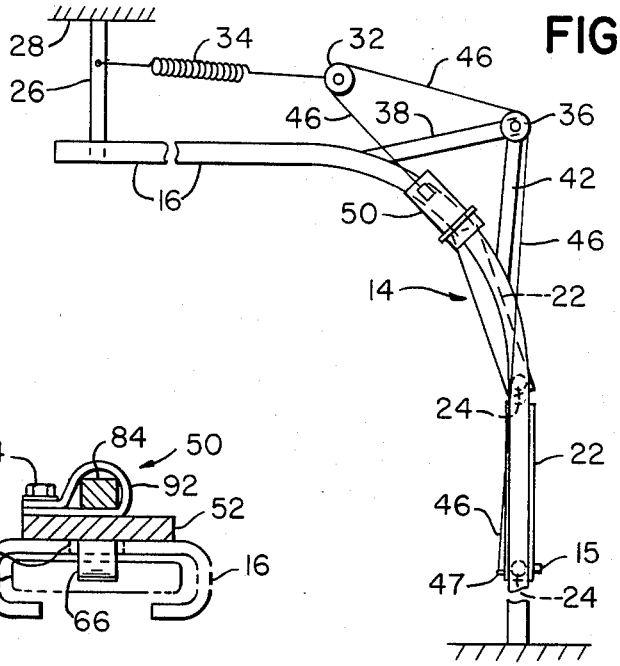
FIG. 2 is a side elevation view of one of the tracks supporting the garage door.

As also seen in FIG. 2, track 16 extends up along the inside of one edge of opening 12 and curves back to a horizontal position at the top of opening 12. Door 14 in this case is articulated, made up of straight panel sections 22 supported on one side by rollers 24 riding in track 16 as is understood in the art. Track 18 is identical to and a mirror image of track 16 with rollers on the other side of door 14 riding in it.

When door 14 is raised by lifting handle 15 the tracks bring the door around to a position over opening 12 and extending back into the garage.

To help counterbalance the weight of door 14, there is provided an identical pulley system with a spring for each track.

For track 16, there is a member 26 extending down from ceiling 28 to support the upper, free end. A pulley wheel 32 is connected at its shaft to member 26 by a spring 34. A second pulley wheel 36 is supported on track 16 by a pair of arms 38 and 42. A cable 46 attached to the bottom of door 14 at 47 passes between door 14 and track 16 up over pulley wheels 36 and 32 and is attached at the other end to some convenient point on track 16, in this case to safety lock assembly 50 to be described below. It is seen that if cable 46 is pulled sufficiently taut extending spring 34 with door 14 closed, there will always be a force exerted by spring 34 counterbalancing the weight of the door, thereby making it easier to move the door controllably up or down. Track 18 is provided with an identical arrangement, and it is understood that this construction except for the lock assembly 50 is in general use, a similar one being used when the door is not articulate.

Should cable 46, spring 34, or any of the connecting points fail while the door is in use, it is seen that it will come crashing down, possibly injuring any person standing in the door opening 12.

In order to prevent such an eventuality, in accordance with the principles of this invention there is provided a lock assembly 50 whose purpose is to lock door 14 instantly against further significant movement upon cable 46 going slack, which would occur in the event of any of the failures occurring as described above.

As seen in FIG. 2, and as previously described, assembly 50 is located on the outside of track 16 at some convenient location of the bend. An identical such assembly would be placed similarly on track 18.

Referring to FIGS. 3–6 for the details of assembly 50, the latter consists of a base plate 52 with a pair of holes 54 and 55 to permit plate 52 to be bolted to track 16.

Mounted adjacent one end of base plate 52 are a pair of side plates 56 and 57 supporting a shaft 58 spaced above plate 52. Pivoted for movement on shaft 58 is a bent lever or arm 62 having left and right extensions **62*a* and 62*b* with an attached sleeve 64 surrounding shaft 58 to permit the limited movement between the two positions shown in FIGS. 5 and 6. The left extension 62*a* of arm 62 has a tooth 66 which passes through an opening 68 in base plate 52**.

Figure 6:
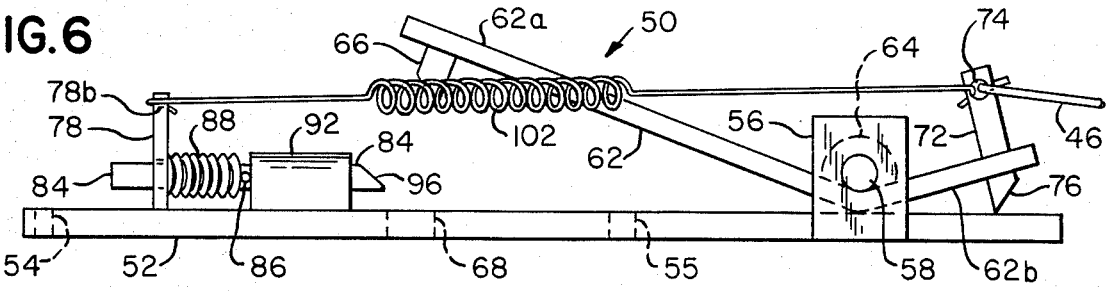
FIG. 6 is an elevation view of the safety lock assembly in the door's operating mode.

Right extension **62*b* has a member 72 extending up at right angles with an opening 74 and a stop member 76 extending downwardly as shown. As seen in FIG. 6, stop 76 limits the clockwise movement of arm 62**.

Figure 3:
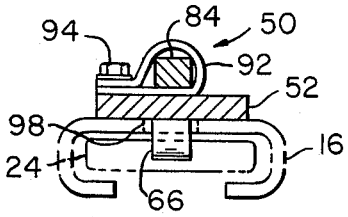
FIG. 3 is a view along 3—3 of FIG. 4 with the lock assembly mounted on a track.
Figure 4:
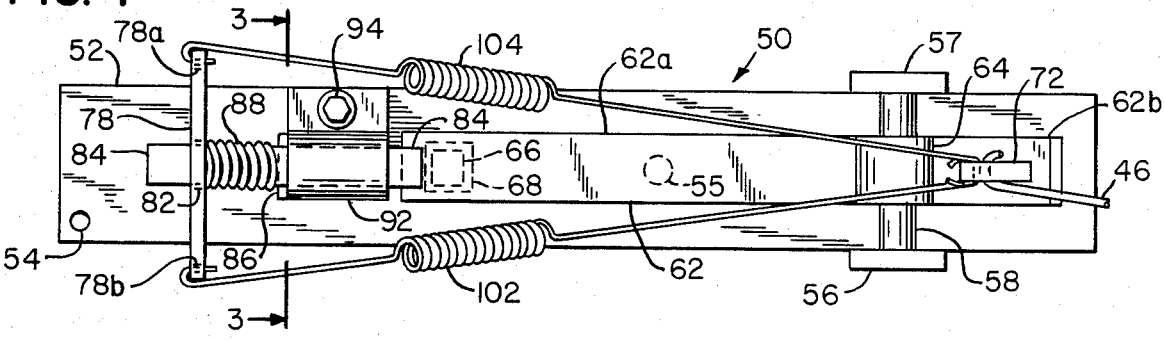
FIG. 4 is a plan view of the safety lock assembly embodying the principles of this invention.

Adjacent the left side of base plate 52 is a cross member 78 with a pair of openings **78*a* and 78*b* near the extremities thereof. An opening 82 centrally located is provided for a tongue member 84 which reciprocates in a manner to be described. Member 84 may be circular, oval, or rectangular in cross section. A cotter pin 86 passing through tongue member 84 supports one end of a spring 88 whose other end is supported by cross member 78 so that in effect member 84 is biased to the right. A sleeve 92 through which member 84 passes is mounted on plate 52 with a bolt 94. Sleeve 92 limits the movement of cotter pin 86 as shown in the figures. Tongue 84 is provided with an upwardly facing biased tip 96 for a reason to be now described. Arm extension 62*a* is in a raised position shown in FIG. 6. When arm extension 62*a* is lowered, that is, arm 62 rotating in a counterclockwise direction, the left tip of extension 62*a* will contact biased tip 96 of tongue member 84 causing the latter to move to the left until extension 62*a* contacts plate 52 thereby permitting member 84 to be moved back to its initial position by spring 88 locking arm 62 into the position shown in FIG. 5. In this position, as seen in FIG. 3, tooth 66 passes through opening 68 in plate 52 and an aligned corresponding opening 98 in track 16, effectively blocking significant movement of wheels 24**.

In order to use assembly 50 there is provided a pair of springs 102 and 104 connected between cross plate 78 and member 74, the ends of said springs hooked into the openings shown provided for this purpose. Springs 102 and 104 act to bias arm 62 into the locked position shown in FIG. 5.

To overcome the bias mentioned above, cable 46 is attached as illustrated to member 72 at its opening 74 using a hook or any other convenient means of making such a connection. Spring 34 provides sufficient force during the full range of positions of door 14 to overcome the bias applied by springs 102 and 104 so that in normal operation of garage door 14 arm 62 is maintained in the position shown in FIG. 6, and cable 46 remains taut.

Figure 5:
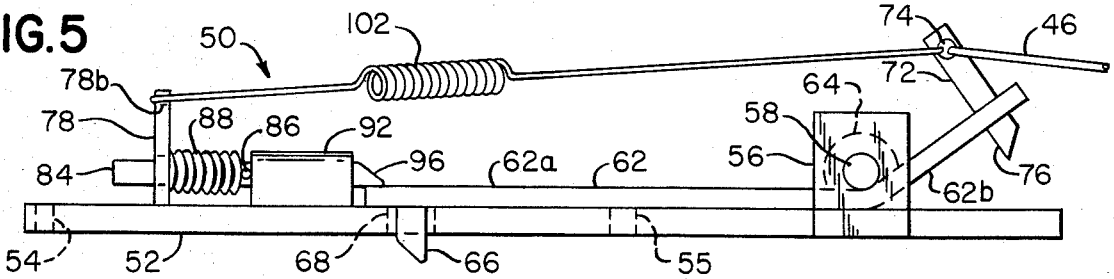
FIG. 5 is an elevation view of FIG. 4 with the safety lock assembly in its locking position.

In the operation of the device just described it is seen that in the event of any cable or spring failure which results in cable 46 becoming slack, arm 62 will be swiftly rotated counterclockwise by springs 102 and 104, depressing tongue member 84 to the left and becoming locked into the position shown in FIG. 5, instantaneously limiting further movement of door 14 to a maximum distance equal to the distance between rollers.

It is thus seen that there has been provided an arrangement for securing a garage door against significant unexpected movement in the event of a failure in the counterweight mechanism.

While only a preferred embodiment of this invention has been described it is understood that many variations in the design thereof are possible without departing from the principles of this invention as expressed in the claims which follow.

What is claimed is:

1. In a garage door operating system having a door opening, a pair of parallel tracks on opposite sides of said door opening extending up the sides of said opening and then turning to extend back into said garage above the opening and substantially parallel to the floor of said garage, a garage door having wheels mounted on the sides thereof for riding within said tracks permitting movement of said garage door between a vertically extending position closing said opening and a fully open position above and back from said opening substantially parallel to the floor of said garage, said door being movable between said positions, said wheels in said tracks guiding said door as the latter moves between its open and closed positions, and means comprising a spring and cable connecting said door to said garage to support at least in part the weight of said door thereby facilitating the raising and lowering of said garage door, the improvement comprising a lock assembly mounted on each of said tracks, means supported by said assembly being biased into a position extending into said track for blocking movement of said wheels, and means for connecting the garage end of said cable and spring to said biased means the force of said spring and weight of said garage door overcoming said bias and holding said biased means out of said position extending into said track, the failure of said spring or cable resulting in slackness in said cable releasing said biasing means with the result that it moves quickly into said track and limits movement of said garage door.

2. The system of claim 1 in which said assembly includes means to lock said biased means in its locking position once the latter moves into said locking position.

3. The system of claim 2 in which said assembly includes a plate mounted on said track, said biased means comprising an arm mounted on said plate being pivotal between its locking position and an operating position maintained by said cable and spring during normal operation of said garage door, and tongue means biased into a position blocking movement of said arm when in its locking position.

4. The system of claim 3 in which said arm is provided at one end with a protuberance which when said arm is in said locking position passes through an opening in said plate and track and limits movement of said wheels.

5. The system of claim 4 in which said tongue means is provided with a biased tip on one face thereof so that rotation of said arm to its locking position causes retraction of said tongue means but prevents rotation of said arm out of its locking position.

* * * * *